US005628083A

United States Patent [19]

Hayes

[11] Patent Number: 5,628,083

[45] Date of Patent: May 13, 1997

[54] BACK CLEANSER AND BALM APPLICATOR

[76] Inventor: Cecil Hayes, 357 S. Mannheim Ave., Egg Harbor, N.J. 08215

[21] Appl. No.: 511,555

[22] Filed: Aug. 4, 1995

[51] Int. Cl.[6] ..... A47K 7/02

[52] U.S. Cl. ..... 15/244.3; 15/244.1; 15/210.1; 4/606; 601/136

[58] Field of Search ..... 15/210.1, 104.92, 15/104.93, 209.1, 223, 244.3, 244.1, 247; 4/606; 601/134, 135, 138; D24/211, 212

[56] References Cited

U.S. PATENT DOCUMENTS

| | | | |
|---|---|---|---|
| 1,358,733 | 11/1920 | Heine . | |
| 1,954,940 | 4/1934 | Mikel . | |
| 1,989,390 | 1/1935 | Davis | D24/211 |
| 2,608,705 | 9/1952 | Duff . | |
| 2,900,757 | 8/1959 | Grimm . | |
| 2,961,682 | 11/1960 | Wurmbock et al. . | |
| 3,289,215 | 12/1966 | Kennedy . | |
| 3,478,369 | 11/1969 | Ensley . | |
| 3,577,985 | 5/1971 | Guffin . | |
| 3,631,560 | 1/1972 | Atkins . | |
| 3,750,226 | 8/1973 | Morgan | 15/210.1 |
| 4,003,372 | 1/1977 | Willoby . | |
| 4,014,051 | 3/1977 | Pettit . | |
| 4,020,519 | 5/1977 | Robison . | |
| 4,040,132 | 8/1977 | Braun | 4/158 |
| 4,047,259 | 9/1977 | Lotis | 401/201 |
| 4,076,876 | 2/1978 | Bowles | 601/134 |
| 4,207,878 | 6/1980 | Ducan | 601/134 |
| 4,417,362 | 11/1983 | Walker | 4/606 |
| 4,696,068 | 9/1987 | Kenner | 15/210.1 |
| 4,699,127 | 10/1987 | Schley | 4/606 |
| 4,759,091 | 7/1988 | Kiss | 15/105 |
| 4,936,294 | 6/1990 | Chu | 601/136 |
| 4,943,018 | 7/1990 | Glaser et al. | 248/110 |
| 5,011,316 | 4/1991 | Damon | 401/6 |
| 5,070,552 | 12/1991 | Centry et al. | 4/615 |
| 5,087,138 | 2/1992 | Terbrusch | 401/206 |
| 5,311,635 | 5/1994 | Moore | 15/210.1 |
| 5,312,666 | 5/1994 | Jovanovic | 4/606 |
| 5,490,302 | 2/1996 | Dion | 15/247 |

FOREIGN PATENT DOCUMENTS

| | | | |
|---|---|---|---|
| 2426432 | 12/1975 | Germany | 4/606 |
| 481824 | 3/1938 | United Kingdom | 15/147 |

*Primary Examiner*—David Scherbel
*Assistant Examiner*—Tony G. Soohoo
*Attorney, Agent, or Firm*—Lennox & Murtha, P.A.

[57] ABSTRACT

A device to clean or apply a balm to a person's back includes a rigid base panel fastened to a wall with suction cups on a shower wall. The device includes a foam panel covered PVC sheet which in turn is covered with a plastic netting to reduce the sliding friction with an overall cover. The device may include a spinal scrubber between the cover and the netting of vertical row of semirigid block members attached to a panel all encased in foam and sealed film. Foam balm applicators may be attached on the cover either in netting pockets or with cotton balls attached on the foam applicators.

12 Claims, 3 Drawing Sheets

BACK CLEANSER AND BALM APPLICATOR

BACKGROUND OF THE INVENTION

This invention involves a device and method of cleansing a person's back as well as application of a balm to the person's back.

Without a second person or some type of device, it is essentially impossible for a person to scratch his or her own back, scrub all of his or her own back in the shower or bath, or apply a balm to the small of his or her own back. Throughout this Specification and Claims, the term "balm" is intended to include any liquid that soothes, heals, or medicares a skin condition. The balm includes lotions, which are typically liquid aqueous suspensions or emulsions for skin conditions, as well as ointments and palliatives for soothing or treatment of dryness, itching, infection, pain, or the like.

A number of devices directed to washing the back include U.S. Pat. No. 4,020,519 to Robison which describes a stationary back scrubber with a resilient backing adhesively adhered to the wall above a bathtub on which a rubber sponge or polyurethane sponge is attached in segments on the front face. A liquid detergent reservoir is cut into the top of the resilient backing opening to the sponge panels on the front. A repositionable T-shaped back cleaning device covered in cloth is described in U.S. Pat. No. 3,750,226 to Morgan. The lotion is released into a sponge applicator on the end of the device by a valve mechanism. The summary of German Patent No. 2426432 describes a shower fitting for back massage and washing which includes a massage plate with full padding and a textile covering. The plate may be connected at the back to a water pipe as it is equipped with water jets or nozzles. A back device is described in U.S. Pat. No. 1,358,733 to Heine which includes a sponge attached to a tube feeding liquid from a reservoir to the sponge which may be applied to those portions of the body that may be reached. A back washing apparatus is described in U.S. Pat. No. 3,478,369 to Ensley with a foam covered horizontally disposed corrugated surface. A back scrubber is described in U.S. Pat. No. 4,040,132 to Braun with horizontally positioned cylindrical scrubbers. A wall-mounted back brush, described in U.S. Pat. No. 4,943,018 to Glaser, et al, is held in a vertical position on the wall with suction cups. A massaging and washing device is described in U.S. Pat. No. 3,577,985 to Guffin using horizontally disposed rollers. A concave back cleaning device utilizing a cloth covered panel is described in U.S. Pat. No. 3,289,215 to Kennedy. A foot washing device is described in U.S. Pat. No. 4,003,372 to Willoby utilizing a pliable corrugated panel. A suntan applicator is described in U.S. Pat. No. 5,087,138 to Terbrusch, et al with a hollow handle into which suntan lotion is poured. Hand held soap holders and scrubbers are described in U.S. Pat. Nos. 2,900,757, 5,011,316, and 5,070,552. A wall mounted bathroom fixture including brushes and sponges for washing a person's back is described in U.S. Pat. No. 4,417,362 to Walker. In U.S. Pat. No. 3,631,560 to Atkins a brush mounted with suction cups on a bathtub sidewall is described.

None of these devices provide as effective accessing of the recesses of a person's back nor provide as effective application of the balm as the invention described herein below.

SUMMARY OF INVENTION

It is an object of the present invention to provide device that allows scratching of the back or application of powder when dry and soap cleaning when wet.

It is a further object of the protection sought to provide a contour that effectively allows scrubbing of the small of the back along the spine which is generally concave and is not easily reached by other devices.

It is a particular object of the present invention to provide a back scrubbing combination that does not slip and slide when saturated with soapy water while still providing a comfortable wash.

It is a further object of the protection sought to provide an applicator which may be attached to the wall of a bath or shower to allow a person to easily apply a balm over the entire expanse of his or her back.

It is a further object of the protection sought to provide an applicator that will apply easy modification of balm composition without changing the entire device.

It is a additional object of the protection sought to provide a balm applicator which allows balm to be absorbed on individual applicators which, by their construction, reduce the tendency of the balm to be spread on the device holding the applicators.

An aspect of the invention is device to aid in cleansing of or application of a balm to a person's back. The device includes a rigid base panel including a front face, a rear face and peripheral edge and fastening means on the rear face to detachably fasten the base panel to a wall. The device further includes a resilient polymeric foam panel essentially coterminous with the base panel and an impervious covering sheet enclosing the foam panel. The device further includes a cover sheet covering a front surface of the impervious covering sheet and extending proximate to the peripheral edge of the base panel and attachment means to detachably hold the cover sheet on the device. The device further includes friction means to reduce the sliding friction between a front face of the impervious covering sheet and an inside face of the detachable fabric cover sheet.

It is preferred that the friction means include a sheet of netting covering the impervious covering sheet and means to attach the sheet of netting to the device. It is further preferred that the cover sheet be pervious and that the device further include a plurality of semirigid or rigid block members separated vertically from each other and arranged in a vertical alignment, and attachment means to attach the block members to a central section of a front face of the device. It is more preferred that block members be of a composition chosen from the group consisting of rubber and semirigid polymeric closed cell foam. It is further preferred that there are at least four block members each including an arched front surface curved horizontally. It is also preferred that the attachment means to attach the block members to the device include a flexible rigid or semirigid elongate panel to which the block members are attached, and attaching means to detachably attach the elongate panel to the front face of the device. It is further preferred that the device further include a flexible polymeric foam sheet covering the block members and an impervious sheet covering and enclosing the foam sheet and being sealably attached to the elongate panel. It is also preferred that the attachment means to detachably attach the elongate panel to the front face of the device include a pair of straps, each strap having terminal end sections attached to the an inside face of the detachable fabric cover sheet, one strap trained over an upper section of the elongate panel and a remaining strap trained over an lower section of the elongate panel. It is further preferred that the fastening means on the rear face include at least three suction cups. It is also preferred that the attachment means to detachably hold the cover sheet on the device include an elastic strip sewn into a border edge of the cover sheet. It is further preferred that the attachment means to detachably hold the cover sheet on the device comprises draw string threaded around a border edge of the cover sheet. It is also preferred that the cover sheet covering a front surface further include a plurality of balm applicators each including a flexible or semirigid polymeric foam member, and attachment means to attach each of the balm applicators to the cover sheet. It is further preferred that each of the balm applicators further include an impervious back sheet positioned between the foam member and the cover sheet. It is also preferred that the balm applicators each further include a wad of loose absorbent fibers, and wad attaching means to attach the wad to a front surface of the foam member. It is further preferred that each wad attaching means include a slit cut into the front surface of the foam member, and a sheet folded along a median line aligning adjacent sides of a face of the sheet, wherein the wad of loose absorbent fibers is adhered between the adjacent sides of the face of the sheet and the sheet is slid into the slit into the foam member. It is also preferred that each of the foam members are flexible open cell polymeric foam and the attachment means to attach each of the applicators to the device include a plurality of pockets each constructed of netting and integrally attached on a front surface of the cover sheet, wherein the pockets are shaped and positioned to hold the applicators spaced apart over a front of the device.

Another aspect of the invention is a device to aid in cleansing of or application of a balm to a person's back. The device includes a rigid base panel that includes a front face, a rear face and a peripheral edge. The device further includes fastening means that includes at least three suction cups on the rear face to detachably fasten the base panel to a wall over drain means to collect and dispose of water showered on the person. The device also includes a resilient polymeric foam panel essentially coterminous with the base panel and an impervious covering sheet enclosing the foam panel. The device further includes at least four rigid or semirigid block members each including an arched upper surface curved horizontally the foam members being separated vertically from each other and arranged in a vertical alignment. The device further includes attachment means to attach the foam members at a central section of the impervious covering sheet that includes a rigid or semirigid polymeric foam elongate panel to which the foam members are attached, and a pair of straps, each strap having terminal ends attached at a horizontally disposed central section of the inside face of the detachable cover sheet, one strap trained over an upper section of the elongate panel and a remaining strap trained over an lower section of the elongate panel. The device further includes a cover sheet covering the block members and a front surface of the impervious covering sheet and extending proximate to the peripheral edge of the base panel. The device also includes attachment means to detachably hold the cover sheet on the device, and friction means to reduce the sliding friction between a front face of the impervious covering sheet and an inside face of the detachable cover sheet.

Yet another aspect of the invention is a device to aid in cleansing of and application of a balm to a person's back. The device includes a rigid base panel that includes a front face and a rear face and fastening means on the rear face to detachably fasten the base panel to a wall over drain means to collect and dispose of water showered on the person. The device further includes a resilient polymeric foam panel essentially coterminous with the base panel and an impervious covering sheet enclosing the foam panel. The device also includes a netting covering sheet enclosing the impervious sheet and a plurality of applicators each including a flexible or semirigid polymeric foam member, and an impervious back sheet positioned between the foam member and the netting. The device further includes attachment means to attach each of the applicators to the device.

DESCRIPTION OF PREFERRED EMBODIMENTS

Figure 1:
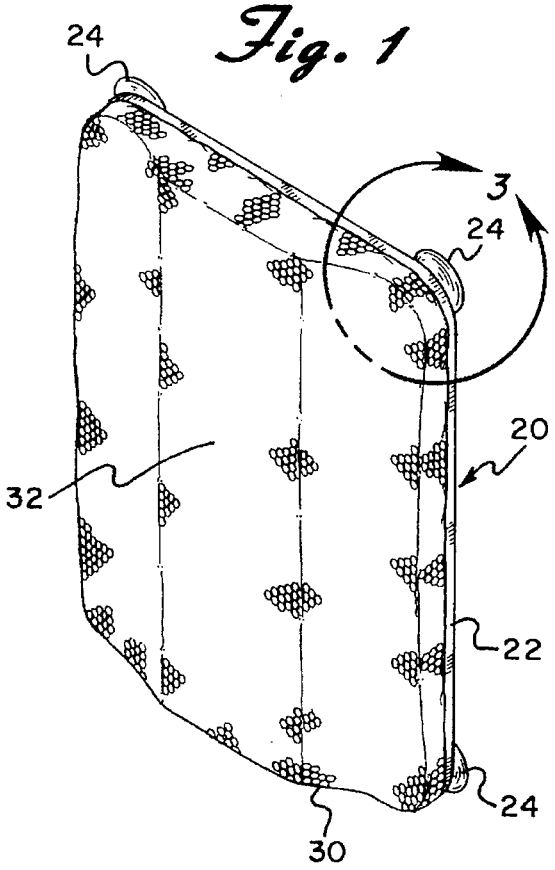
FIG. 1 is a perspective view of the front, top, and right side perspective view of a base unit of the present invention.
Figure 2:
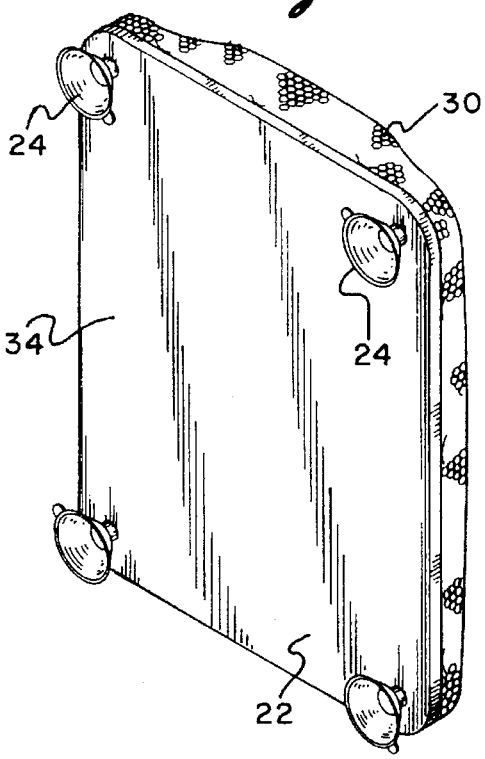
FIG. 2 is a rear, bottom, right side perspective view thereof.
Figure 3:
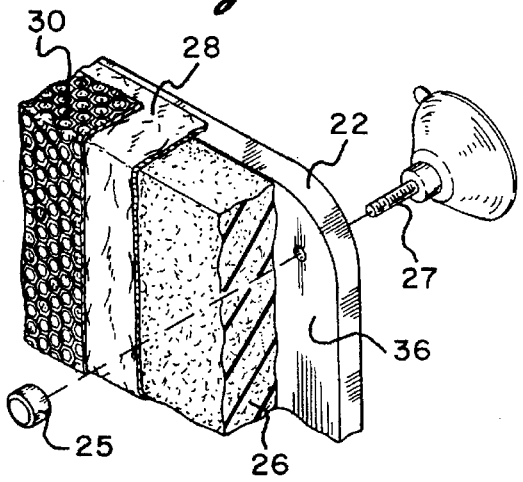
FIG. 3 is a cutaway sectional view taken along line 3 of FIG. 1.
Figure 4:
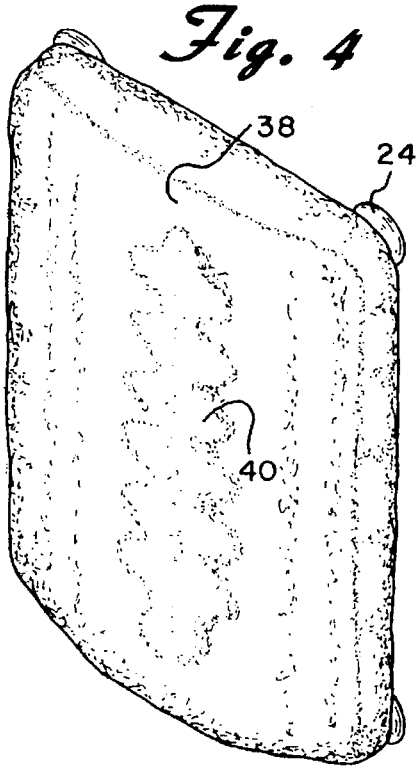
FIG. 4 is a front, top, right side perspective view of a device of the present invention.
Figure 5:
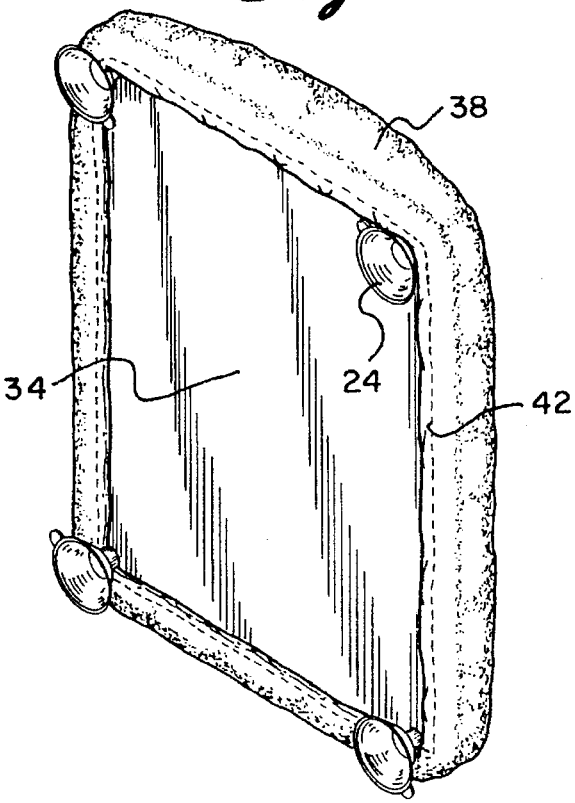
FIG. 5 is a rear, bottom, right side perspective view thereof.
Figure 6:
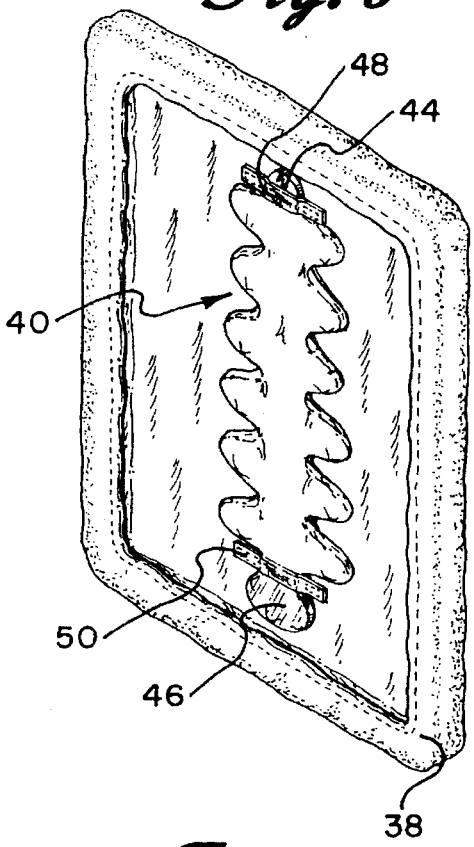
FIG. 6 is a rear perspective view of an outside cover of the invention showing attachment of the spinal bar on the inner surface.
Figure 7:
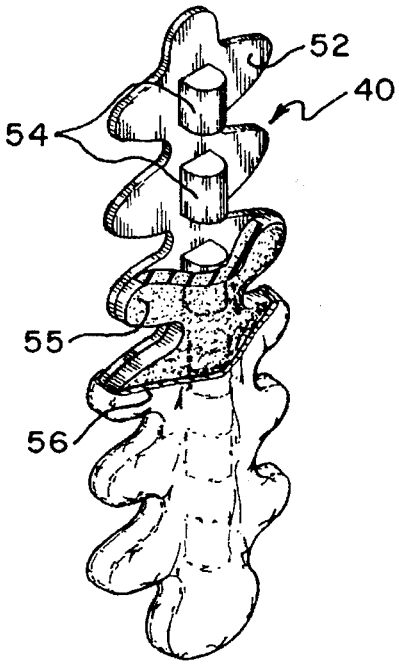
FIG. 7 is a perspective view of the spinal bar shown in FIG. 6 cut away to show construction thereof.
Figure 8:
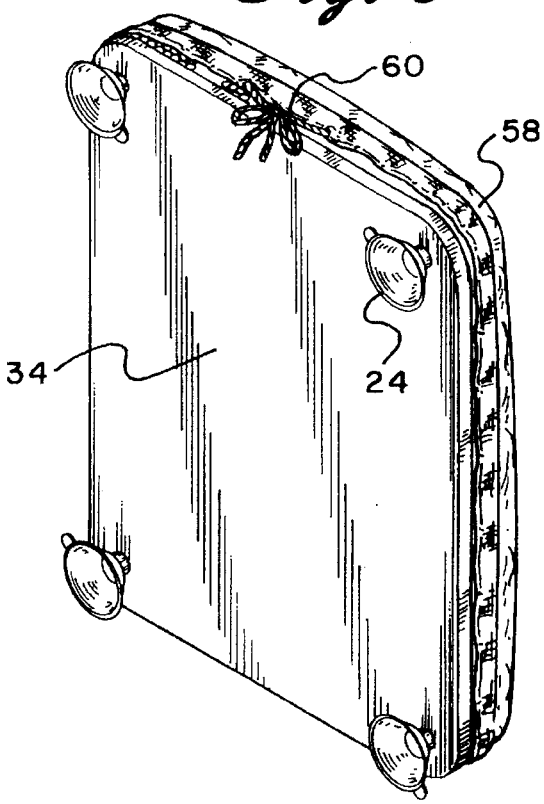
FIG. 8 is a rear, bottom, right side perspective view of the base unit illustrated in FIG. 1 with a second embodiment applicator cover attached.
Figure 9:
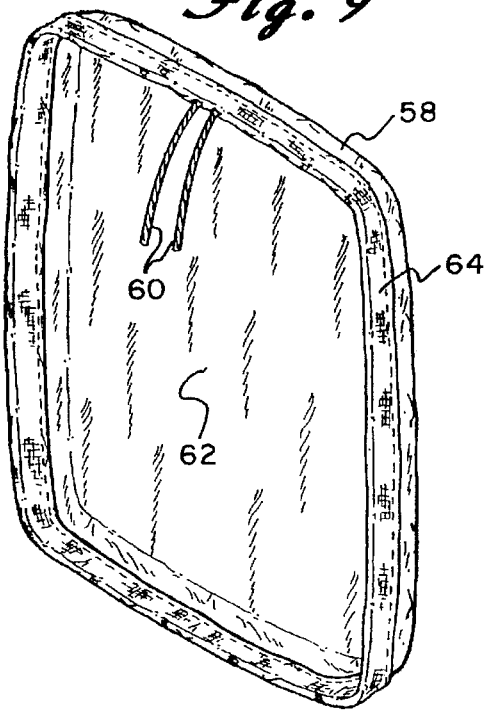
FIG. 9 is a rear perspective view of said applicator cover.
Figure 12:
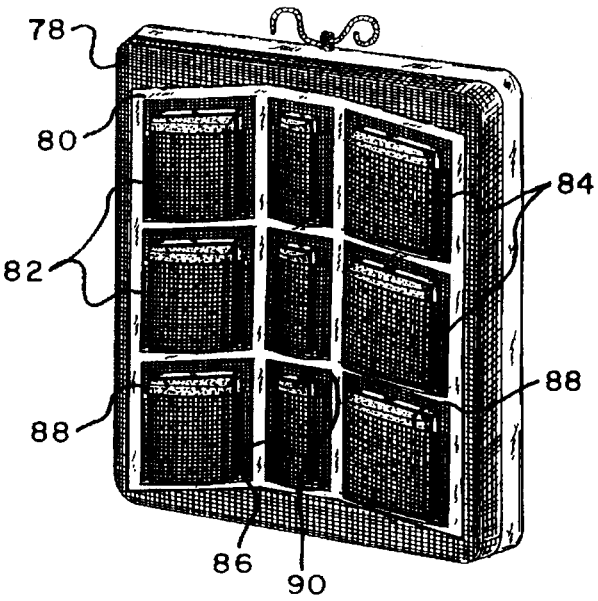
FIG. 12 is a second embodiment of an applicator cover of the present invention.
Figure 11:
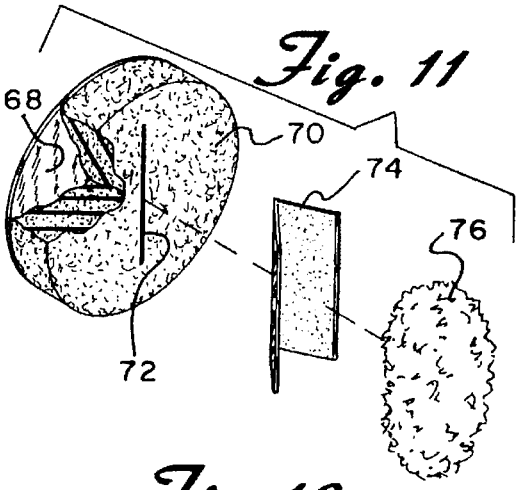
FIG. 11 is an exploded, partially cutaway perspective view of an applicator shown in FIG. 10.
Figure 10:
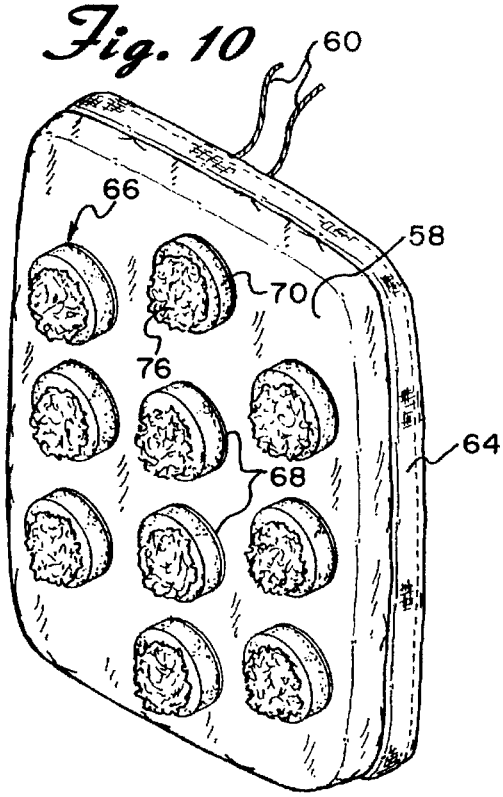
FIG. 10 is a front top, right side perspective view of said applicator cover.
Figure 13:
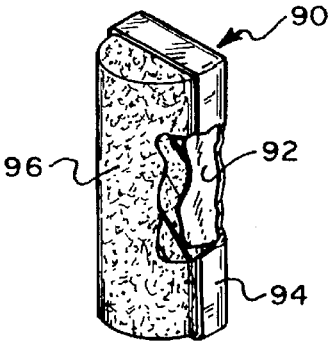
FIG. 13 is a partially cutaway perspective view of an applicator pad shown in FIG. 12.

Device 20 as illustrated in FIGS. 1, 2, and 3 is a base unit of the invention including base panel board 22 which is rigid, constructed of wood, impregnated or coated with waterproof coating or of rigid plastic. Suction cups 24 located on rear face 34 of base panel 22 securely, but temporarily, attach device 20 to a wall such as a shower stall wall or a ceramic or plastic wall over a bathtub. The device may be easily removed and attached to a wall away from a drain for use when dry or for application of various balms from applicators on the device described herein below. Device 20 is further constructed of flexible closed cell urethane foam pad 26 which is encased and covered with plasticized polyvinyl chloride film 28 which is further covered with nylon plastic netting 30. The edges of film 28 and netting 30 are attached with adhesive or mechanical fasteners to the edge of base board 20. Suction cup attachments 24 are attached with bolt 27 extending through a hole in board 22 threaded on nut 25 which is tightened to secure suction cup 24 to the rear of device 20. In FIGS. 4 and 5, base unit 20 has been prepared for use by adding terry cloth cover 38 which is held in place by elasticized border 42. Cover 38 holds and covers spinal bar unit 40 which is shown in FIGS. 6 and 7. Unit 40 is attached to an inner surface of cover 38. Spinal bar 40 includes upper section 44 and lower section 46. Upper strap 48 and lower strap 50 extend over sections 44 and 46, respectively. Straps 50 and 52 are each stichably attached at their respective ends to cover 38 leaving a center section free extending horizontally across central section 32 of unit 20. Straps 48 and 50 are respectively positioned at upper and lower positions on section 32 so that base panel 52 of unit 40 may be slipped in and out of the attachment mechanism. Base panel 52 is constructed of a rigid or semi-rigid thermal plastic polymer or a rigid or semi-rigid high density closed cell foam to allow it to engage and disengage from straps 50 and 52. Unit 40 also includes block members 54 which are spaced apart in a vertical alignment with an arcuate shape curved horizontally. It is preferred to have at least four lock members constructed of a semi-rigid plastic or rubber or high density close cell foam adhesively attached to base panel 52. Foam interlayer 55 is cut to the same shape as base panel 52 and is preferably a soft flexible polyurethane closed cell foam. The entire unit 40 is covered and heat sealed with flexible film 56 which may be plasticized polyvinyl chloride or a polyolfin. In a second embodiment cover 56 is attached through drawstring 60 to device 20 as shown in FIGS. 8 and 9. Cover 58 is constructed of a waterproof plastic coated paper that may be disposed after use. Inside surface 62 has a relatively high coefficient of friction against netting 30 reducing the tendency for cover 58 to slide. Drawstring 60 is trained through hemmed edge 64. On the front of cover 58 are ten individual applicators 66 which may be permanently attached to cover 58 with contact adhesive or temporarily attached through VELCRO® fabric attachments. Each applicator 66, as shown in FIG. 11, includes flexible closed cell foam disk 70 backed with plastic sheet 68 which is in turn attached to cover 58. Slit 72 is cut a medial distance into the front face of foam disk 70 to receive folded waterproof paper sheet 74 with cotton ball 76 adhesively attached into the V-shaped paper shape. Supplies of a combination of cotton ball 76 on paper 74 may be used and thrown away after application of a balm. A balm may be applied directly to cotton ball 76 after it is in place on foam disk 70 or may be first applied to the ball and the ball then inserted into slot 72. Applicators 70 may be strategically placed to reach the inaccessible areas of a person's back or the particular areas that need treatment. In FIG. 10, cover 78 is constructed of a netting is attached on base unit 20. Although the main body of cover 78 is shown as a netting, it may just as easily be an impervious sheet such as coated paper or a plastic film. If the main body of cover 78 is an impervious film, impervious sheet 80 will not be necessary. In this embodiment impervious sheet 80 extends over the front face of cover 78 and under left side pockets 82, right side pockets 84, and center pockets 86. These pockets are constructed of porous nylon netting which allows any fluids to easily seep through and be applied to a person's back. Side foam applicators 88 and center foam applicators 90 are opened cell flexible plastic foam blocks. As shown in FIG. 13, center foam applicator 90 includes a plasticized PVC backing sheet 92 formed in cup-shape 92 at the bottom encasing foam 96. With appropriate impervious covering of the device vinyl backing 92 is not necessary.

While this invention has been described with reference to specific embodiments disclosed herein, it is not confined to the details set forth and the patent is intended to include modifications and changes which may come within and extend from the following claims.

I claim:

1. A device to aid in cleansing of or application of a balm to a person's back, the device comprising:

(a) a rigid base panel comprising a front face, a rear face and peripheral edge, (b) fastening means on the rear face to detachably fasten the base panel to a wall, (c) a resilient polymeric foam panel essentially coterminous with the base panel, (d) a water impervious covering sheet enclosing the foam panel holding the foam panel to the base panel defining a main body, (e) a water pervious fabric cover sheet covering a front surface of the impervious covering sheet and extending proximate to the peripheral edge of the base panel, the fabric cover sheet comprising an inside surface facing the main body, (f) attachment means to detachably hold the fabric cover sheet on the main body, and (g) friction means to reduce the sliding of the inside surface of the fabric cover sheet over the front surface of the impervious covering sheet.

2. The device of claim 1 wherein the friction means comprises a sheet of open mesh netting covering the impervious covering sheet and means to attach the sheet of netting to the main body.

3. The device of claim 1 further comprising:

(a) a plurality of block members separated vertically from each other and arranged in a vertical alignment, and (b) attachment means to attach the block members to the inside surface of the fabric cover sheet.

4. The device of claim 3 wherein the block members are all of a composition chosen from the group consisting of rubber and semirigid polymeric closed cell foam.

5. The device of claim 3 wherein there are at least four block members each comprising an outer arched vertically disposed curved front surface with the block members aligned vertically to each other.

6. The device of claim 1 wherein the fastening means on the rear face comprises at least three suction cups.

7. The device of claim 1 wherein fabric cover sheet comprises a border edge and the attachment means to detachably hold the fabric cover sheet on the main body comprises an elastic strip sewn into the border edge of the fabric cover sheet.

8. The device of claim 1 wherein the fabric cover sheet comprises a border edge and the attachment means to detachably hold the fabric cover sheet on the device comprises draw string threaded around the border edge of the cover sheet.

9. A device to aid in cleansing of or application of a balm to a person's back, the device comprising:

(A) a rigid base panel comprising a front face, a rear face and peripheral edge, (B) fastening means on the rear face to detachably fasten the base panel to a wall, (C) a resilient polymeric foam panel essentially coterminous with the base panel, (D) a water impervious covering sheet enclosing the foam panel holding the foam panel to the base panel defining a main body, (E) a water pervious fabric cover sheet covering a front surface of the impervious covering sheet and extending proximate to the peripheral edge of the base panel, the fabric cover sheet comprising an inside surface facing the main body, (F) attachment means to detachably hold the fabric cover sheet on the main body, (G) a plurality of block members separated vertically from each other and arranged in a vertical alignment, and (H) attachment means to attach the block members to the inside surface of the fabric cover sheet comprising (i) a flexible elongate panel to which the block members are attached, and (ii) attaching means to detachably attach the elongate panel to the inside surface of the fabric cover sheet, and (I) friction means to reduce the sliding of the inside surface of the fabric cover sheet over the front surface of the impervious covering sheet.

10. The device of claim 9 further comprising a flexible polymeric foam sheet covering the block members and an impervious sheet covering and enclosing the foam sheet and being sealingly attached to the elongate panel.

11. The device of claim 9 wherein the attachment means to detachably attach the elongate panel to the inside surface of the fabric cover sheet comprises a pair of straps, each strap having terminal end sections attached to an inner surface of the cover sheet, one strap trained over an upper section of the elongate panel and a remaining strap trained over a lower section of the elongate panel.

12. A device to aid in cleansing of or application of a balm to a person's back, the device adapted to be attached to a wall over drain means to collect and dispose of water showered on the person, the device comprising:

(a) a rigid base panel comprising a front face, a rear face and peripheral edge, (b) fastening means comprising at least three suction cups on the rear face to detachably fasten the base panel to the wall over the drain means, (c) a resilient polymeric foam panel having a shape that is essentially coterminous with the front face of the base panel, (d) a water impervious covering sheet enclosing the foam panel holding the foam panel to the base panel defining a main body, (e) a cover sheet covering a front surface of the water impervious covering sheet and extending proximate to the peripheral edge of the base panel, the cover sheet comprising an inside surface facing the main body, (f) at least four block members each comprising an outer arched vertically disposed curved surface with the block members aligned vertically to each other, the block members being separated vertically from each other, (g) attachment means to attach the foam members at a central section of the inside surface of the cover sheet comprising:

(i) a rigid or semirigid polymeric foam elongate panel to which the foam members are attached, and (ii) a pair of straps, each strap having terminal ends attached at a horizontally disposed central section of an inner surface of the inside surface of the cover sheet, one strap trained over an upper section of the elongate panel and a remaining strap trained over an lower section of the elongate panel, and (h) attachment means to detachably hold the cover sheet on the main body, and (i) friction means to reduce the sliding of an inside surface of the detachable fabric cover sheet over the front surface of the impervious covering sheet.

* * * * *